US007854344B2

(12) United States Patent
Suk

(10) Patent No.: US 7,854,344 B2
(45) Date of Patent: Dec. 21, 2010

(54) LID HAVING LOCKING FLAP HANDLES WITH IMPROVED ELASTIC HINGES FOR AIRTIGHT CONTAINERS

(76) Inventor: Jong Cheul Suk, juan Hyundai Hometown Apt. 104 dong 1006 ho, 13-1 Juan 5-dong, Nam-gu, Incheon (KR)

( * ) Notice: Subject to any disclaimer, the term of this patent is extended or adjusted under 35 U.S.C. 154(b) by 177 days.

(21) Appl. No.: 12/240,327

(22) Filed: Sep. 29, 2008

(65) Prior Publication Data

US 2009/0218360 A1 Sep. 3, 2009

(30) Foreign Application Priority Data

Feb. 29, 2008 (KR) ..... 10-2008-0019116

(51) Int. Cl.
*B65D 45/22* (2006.01)

(52) U.S. Cl. ..... 220/326; 220/318; 220/324; 220/784; 220/788

(58) Field of Classification Search ..... 220/318, 220/323, 324, 326, 784, 788
See application file for complete search history.

(56) References Cited

U.S. PATENT DOCUMENTS

| | | | | | |
|---|---|---|---|---|---|
| 2,210,183 | A * | 8/1940 | Schweighart | 206/557 |
| 3,179,287 | A * | 4/1965 | Rickmeier, Jr. | 220/324 |
| 3,294,274 | A * | 12/1966 | Spitzberg | 220/803 |
| 3,688,942 | A * | 9/1972 | Mitchell et al. | 220/784 |
| 3,817,419 | A * | 6/1974 | Moller et al. | 220/315 |
| 4,494,674 | A * | 1/1985 | Roof | 220/784 |
| 5,085,337 | A * | 2/1992 | Kos | 220/324 |
| 5,531,345 | A * | 7/1996 | Nakamura et al. | 220/3.8 |
| 5,574,254 | A * | 11/1996 | Mori et al. | 174/561 |
| 5,641,065 | A * | 6/1997 | Owens et al. | 206/370 |
| 5,887,745 | A * | 3/1999 | Wood | 220/326 |
| 6,202,887 | B1 * | 3/2001 | Petit | 220/849 |
| 6,269,967 | B1 * | 8/2001 | de Vries | 220/669 |
| 6,415,947 | B1 * | 7/2002 | Kim | 220/788 |
| 6,793,096 | B1 * | 9/2004 | Seok | 220/788 |
| 7,090,089 | B2 * | 8/2006 | Lown et al. | 220/324 |
| 7,255,228 | B2 * | 8/2007 | Kim | 206/320 |
| 2004/0084464 | A1 * | 5/2004 | Koo | 220/784 |
| 2005/0006390 | A1 * | 1/2005 | Wang | 220/326 |
| 2005/0035125 | A1 * | 2/2005 | Bae | 220/326 |
| 2005/0139604 | A1 * | 6/2005 | Kim | 220/788 |
| 2008/0041858 | A1 * | 2/2008 | Furlong et al. | 220/378 |
| 2008/0110911 | A1 * | 5/2008 | Chen | 220/788 |

* cited by examiner

*Primary Examiner*—Anthony Stashick
*Assistant Examiner*—Ned A Walker
(74) *Attorney, Agent, or Firm*—Notaro, Michalos & Zaccaria P.C.

(57) ABSTRACT

A lid for an airtight container has a rim part for sealing to the container and plural locking flap handles extending from the rim part and rotating between open and locked positions. Each handle has a locking protrusion for locking to the container in its locked position, and a film hinge with an outer surface that smoothly curves continuously into an upper surface of the rim part of the lid, in the open position of the handle. The film hinge has an elastic hinge part that extends by a predetermined length to disperse an impact generated when the handle is locked to the container and the elastic hinge part is folded as the handle is moved from its open to its locked position.

3 Claims, 8 Drawing Sheets

LID HAVING LOCKING FLAP HANDLES WITH IMPROVED ELASTIC HINGES FOR AIRTIGHT CONTAINERS

BACKGROUND OF THE INVENTION

1. Field of the Invention

The present invention relates generally to lids for airtight containers and, more particularly, to a lid for an airtight container which is configured such that the impact generated when locking the lid to the container body is minimized, thus improving the durability of the lid, and such that the smooth flow of raw material is ensured when forming the lid, thus preventing production defects.

2. Description of the Related Art

As well known to those skilled in the art, airtight containers contain and store food therein. Such an airtight container includes a container body, which is open on the upper end thereof to contain food therein, and a lid, which seals the open upper end of the container body.

FIGS. 1A and 1B are enlarged sectional views showing critical parts of a container body 10 and a lid 20 to illustrate the coupling therebetween, according to a representative example of the conventional technique. As shown in the drawings, a sealing member 30 is interposed between the container body 10 and the lid 20 to airtightly seal the container body. Furthermore, a locking depression 11 is formed in the outer edge of the open upper end of the container body 10. Locking flap handles 21, each of which has a locking protrusion 22 to be locked to the locking depression 11 of the container body 10, are rotatably connected to the outer surface of a rim part of the lid 20 by a film hinge 23. The film hinge 23 is connected to a gusset part 24, which protrudes outwards from the outer surface of the rim part of the lid 20, such that the locking flap handle 21 is rotatable upwards or downwards.

As shown in FIG. 1A, in the state in which the lid 20 is placed on the container body 10, the locking flap handles 21 are rotated downwards (in the direction designated by the arrow) around the respective film hinges 23. Then, the locking protrusion 22 of each locking flap handle 21 is locked to the locking depression 11. Thereby, as shown in FIG. 1B, the container body 10 is airtightly sealed.

However, the conventional airtight container having the above-mentioned construction has the following several problems.

First, synthetic resin or glass is typically used as raw material for the conventional container body 10. In the case of such material, due to a thermal change in the state between molecules, a contraction phenomenon, by which the dimensions of the container body 10 are reduced and the shape of the container body 10 thus varies, is induced. Hence, the dimensions of the manufactured container bodies 10 may become different from each other.

In other words, as shown in FIG. 1A, the length l between the open upper end of the container body 10 and the locking depression 11 may vary depending on a contraction rate of the manufactured container body 10. The length l may exceed a desired tolerance range.

Here, in the case where the length l is relatively short, because the lid 20 has the sealing member 30, which is elastically changed in shape within a predetermined range, there is no difficulty in covering and sealing the container body 10 without applying an excessive load to the film hinge 23. However, in the case where the length l is relatively long, when the locking protrusion 22 is locked to the locking groove 11, a relatively large load is applied to the film hinge 23, thus increasing creep. Thereby, impact occurring at the time of locking is concentrated on the film hinge 23. As a result, a crack may occur in the film hinge 23, with the result that the film hinge 23 tears.

In brief, as shown in FIGS. 1A and 1B, the film hinge 23 is very thin compared to the gusset part 24 or the locking flap handle 21. Typically, the film hinge 23 is about 0.3 mm thick, in consideration of the rotation of the locking flap handle, locking and unlocking operations thereof, and shear fracture thereof. Therefore, in the case where the length l is relatively long, impact is concentrated on the film hinge 23, which is relatively thin. As a result, the film hinge 23 may be damaged, particularly, easily tear.

Second, in the case of the lid 20 made of synthetic resin, in a portion of a mold for forming the film hinge 23 of the lid 20, which is relatively thin and thus forms a stepped portion on the outer edge of the lid 20, the smooth flow of raw material is not ensured. Hence, there is a problem in that a defective forming phenomenon, such as an unforming or albinic phenomenon, may occur in the event that material is insufficiently charged into the portion of the mold corresponding to the film hinge 23 when forming the lid 20.

Third, in the conventional technique, because the film hinge 23 is connected to the gusset part 24, which protrudes outwards from the outer surface of the rim part of the lid 20, when the locking protrusion 22 is locked to the locking depression 11, a gap d is defined between the outer surface of the rim part of the lid and the inner surface of the locking flap handle 21, as shown in FIG. 1B. Therefore, creep is concentrated on the film hinge 23, so that there is a problem in that shear fracture of the film hinge 23 is promoted.

SUMMARY OF THE INVENTION

Accordingly, the present invention has been made keeping in mind the above problems occurring in the prior art, and an object of the present invention is to provide a lid for an airtight container which is configured such that the impact occurring when the lid is locked to the container body to seal the container body is minimized, thus improving the durability of the lid.

Another object of the present invention is to provide a lid for airtight container which is configured such that the smooth flow of raw material when forming the lid is ensured, thus preventing production defects.

In order to accomplish the above object, the present invention provides a lid for airtight containers, including a lid body, and a plurality of locking flap handles coupled to the lid body so as to be rotatable, each of the locking flap handles having a locking protrusion to be locked to a locking depression formed in an outer edge of an upper end of a container body. The locking flap handles are connected to the lid body by respective film hinges. Each of the film hinge include: an elastic hinge part, which is continuous with an upper surface of the lid without having a stepped portion, the elastic hinge part being curved outwards at a predetermined curvature; and a connection part for connecting the elastic hinge part to the locking flap handle, the connection part extending a predetermined length to disperse an impact generated when the locking flap handle is locked to the container body, wherein, when the locking flap handle is locked to the container body, the elastic hinge part is folded around an inner corner, forming a boundary between the elastic hinge part and the lid body, and is elastically brought into contact with an outer surface of the lid body.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a preferred embodiment of the present invention will be described in detail with reference to the attached drawings.

Figure 2:
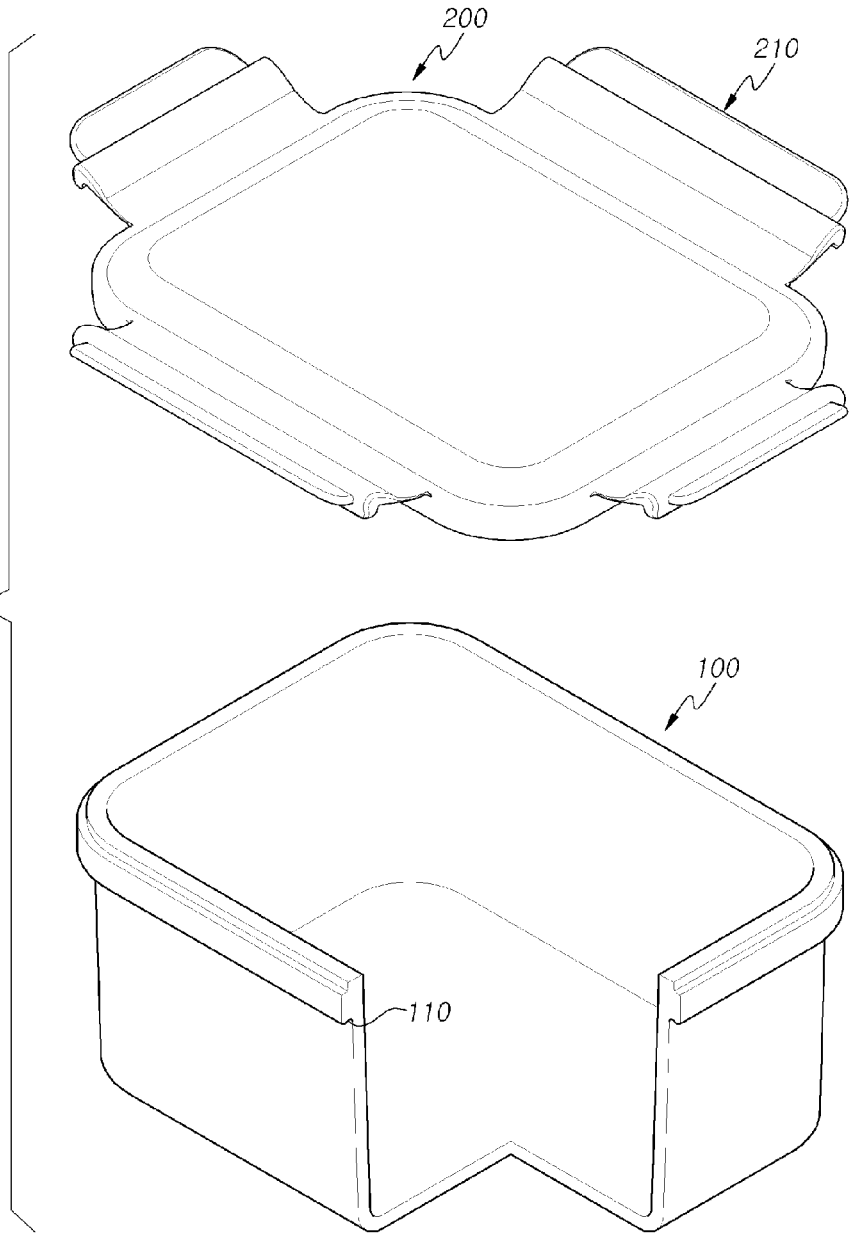
FIG. 2 is an exploded perspective view showing a container body and a lid, according to an embodiment of the present invention.

In the present invention, as shown in FIG. 2, an airtight container includes a container body 100, which is open on the upper end thereof to contain food therein, and a lid 200, which seals the open upper end of the container body 100.

In FIG. 2, although the container body 100 is illustrated as having a rectangular shape and the lid 200 is illustrated as having a rectangular plate shape, those skilled in the art will appreciate that the container body 100 can have other various shapes, for example, a cylindrical shape or a polyhedral shape, and that the lid 200 can be formed to have a shape corresponding to the container body 100.

In the present invention, a locking depression 110 is formed in the circumferential outer edge of the open upper end of the container body 100, so that locking protrusions 212 of the lid 200, which will be explained later herein, are locked to the locking depression 110. Preferably, the container body 100 is made of glass or ceramic, which are unrelated to the problem of harmful environmental hormones, which has been a hot issue recently. However, those skilled in the art will appreciate that, as necessary, the container body 100 may be formed using synthetic resin, such as polyethylene (PE), polypropylene (PP), etc., which is widely used to manufacture containers.

Figure 3:
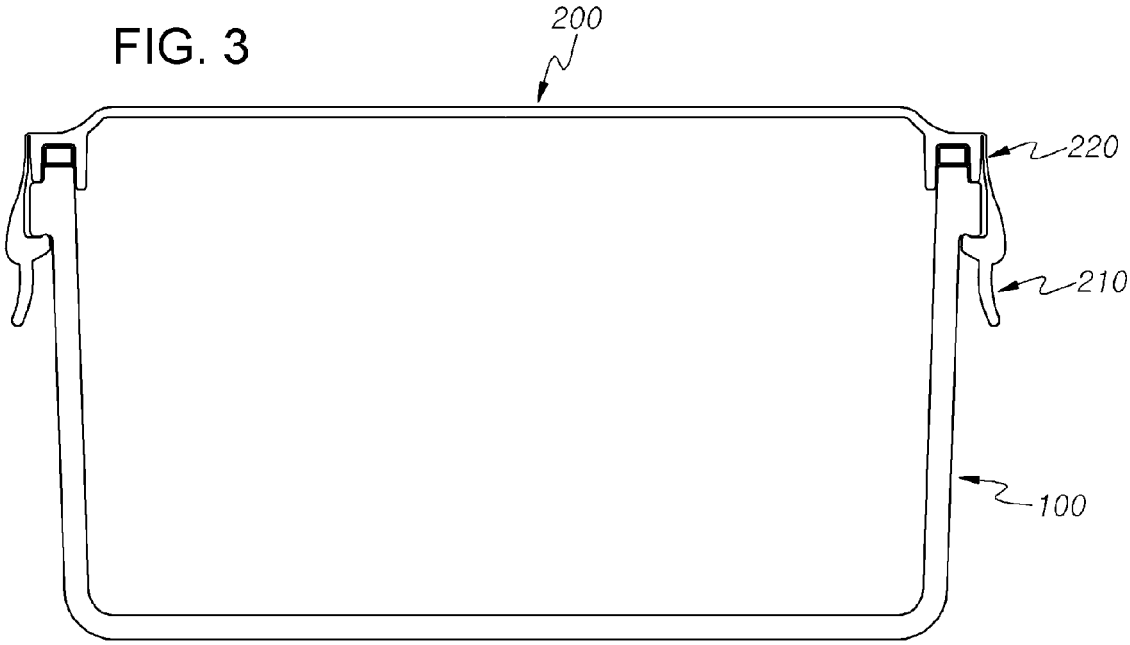
FIG. 3 is a sectional view showing the coupling between the container body and the lid according to the embodiment of the present invention.
Figure 4:
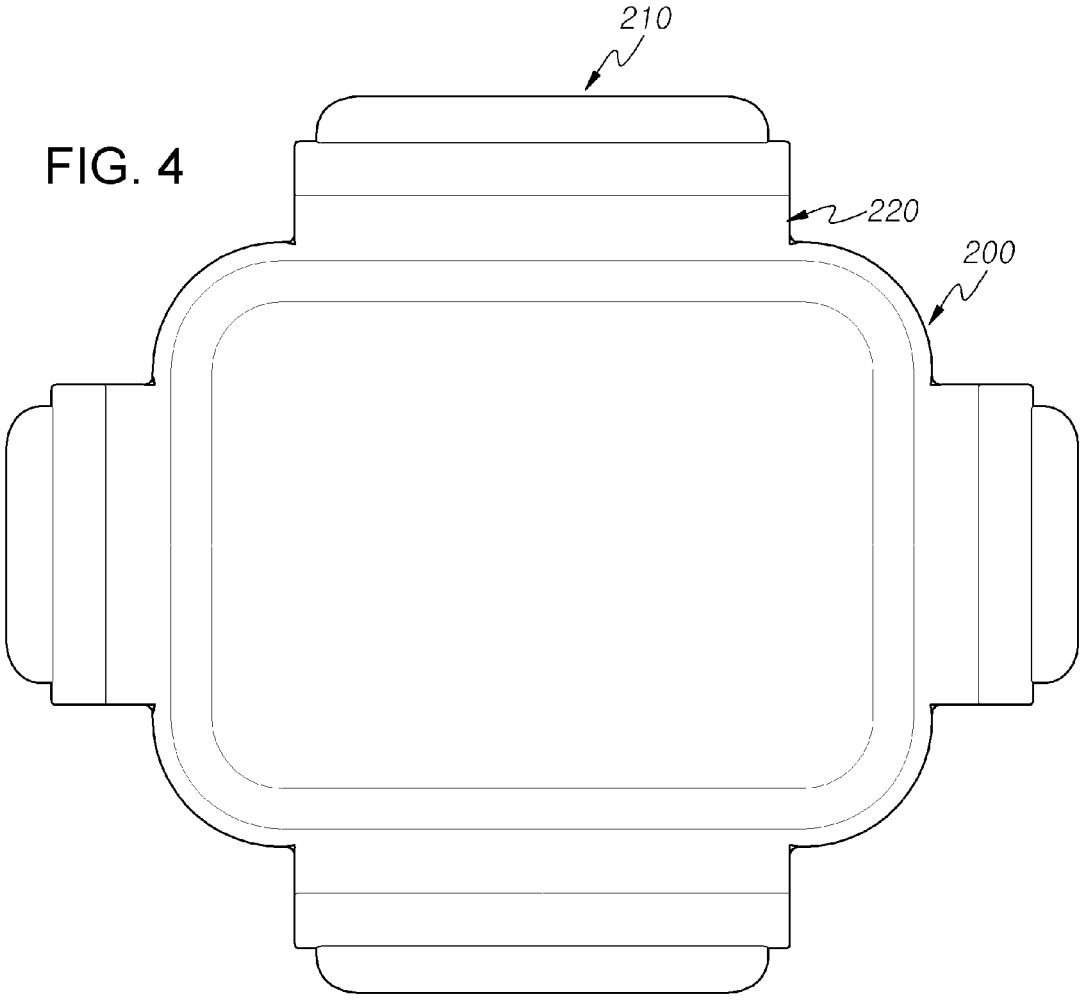
FIG. 4 is a plan view of the lid according to the embodiment of the present invention.

Referring to FIG. 3, showing a sectional view of the coupling between the container body 100 and the lid 200, a seating depression 230 is formed in the rim part of the lower surface of the lid 200. A sealing member 300 is provided in the seating depression 230. When the lid 200 is coupled to the container body 100, the sealing member 300 is brought into close contact with the open upper end of the container body 100, thus airtightly sealing the container body 100.

Locking flap handles 210 are connected to the outer surface of the rim part of the lid 200 through respective film hinges 220 to releasably lock the lid 200 to the container body 100. A locking protrusion 212 is provided on the inner surface of each locking flap handle 210. The locking protrusions 212 of the locking flap handles 210 are locked into the locking depression 110 of the container body 100.

Figure 5A:
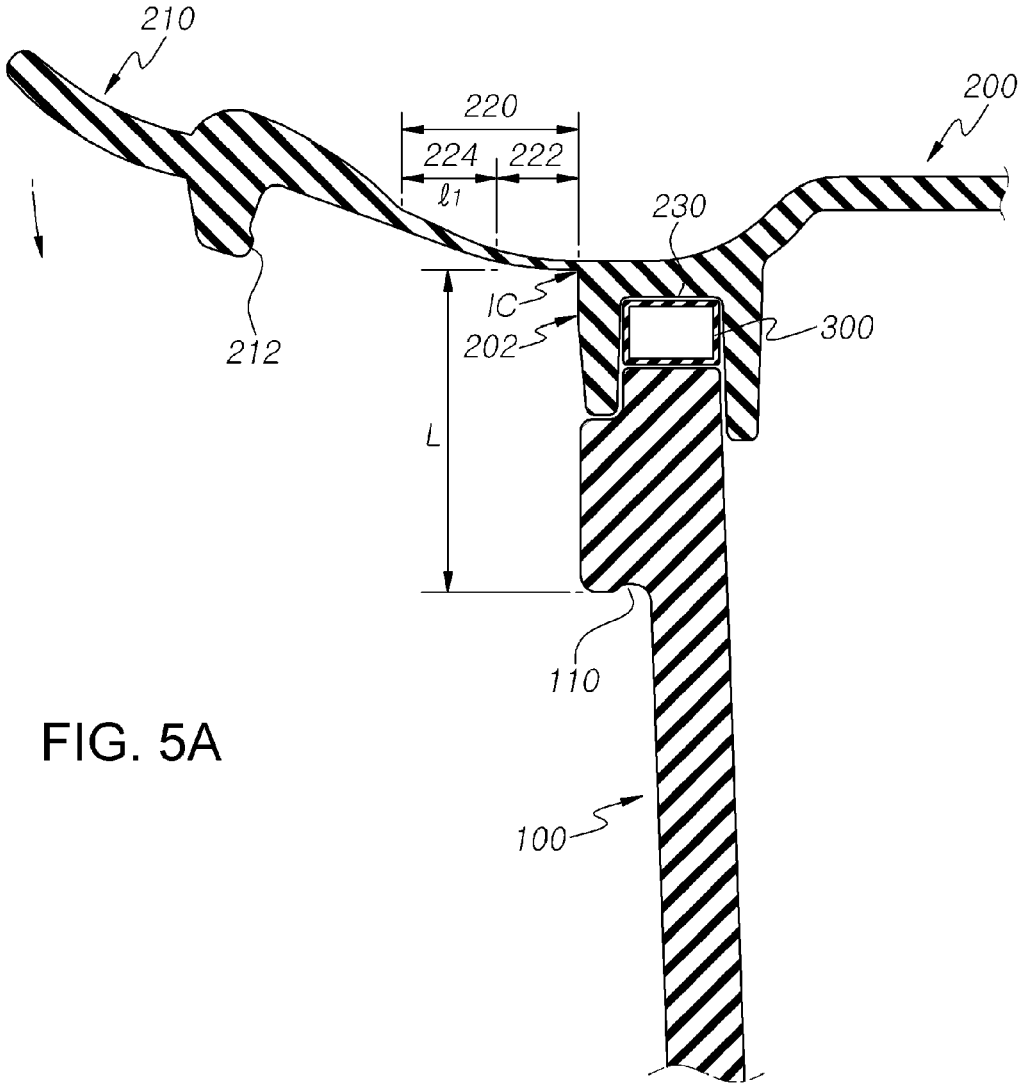
FIGS. 5A through 5C are enlarged sectional views showing critical parts of the container body and the lid to illustrate the coupling process therebetween according to the embodiment of the present invention.
Figure 5B:
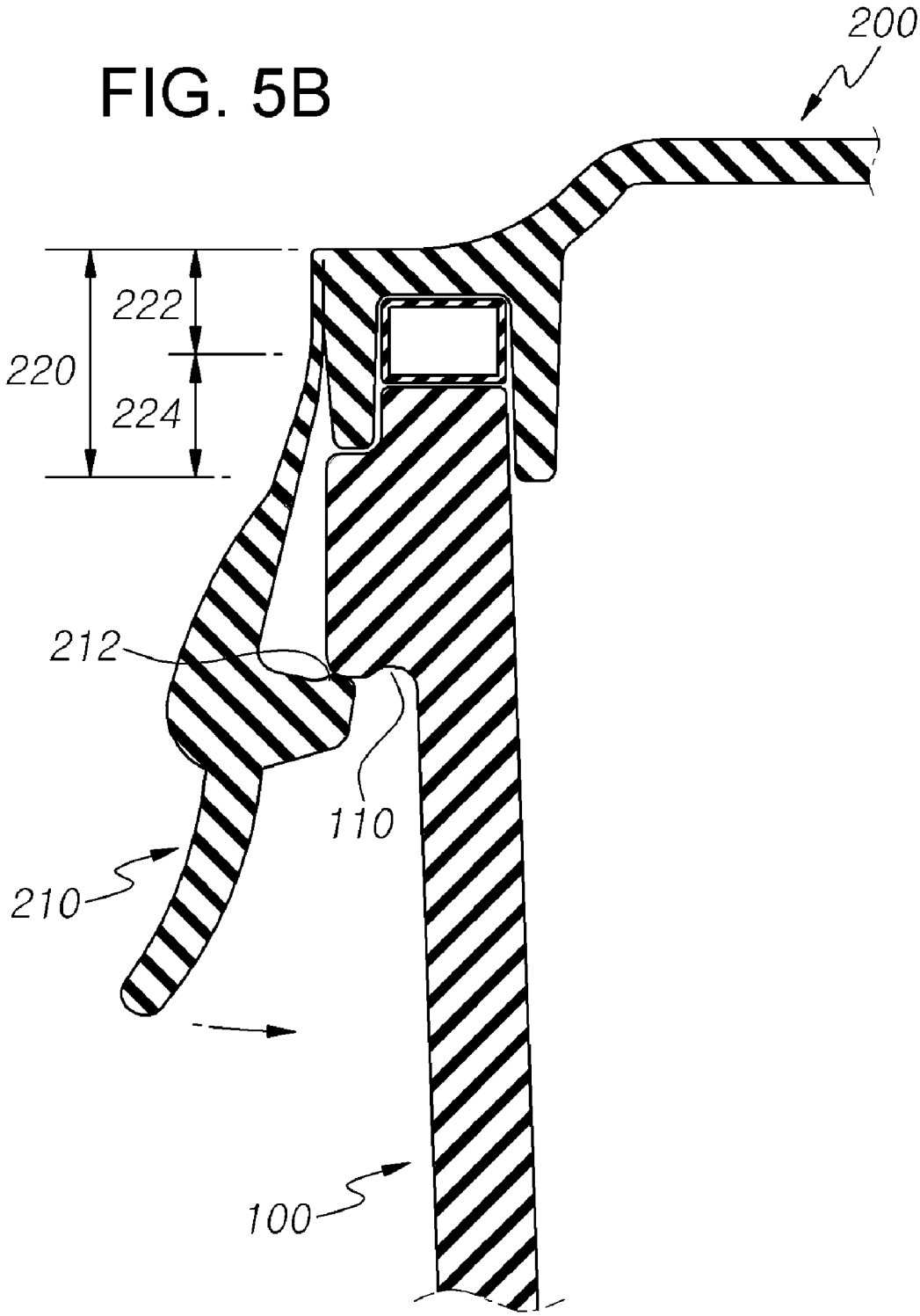
Figure 5C:
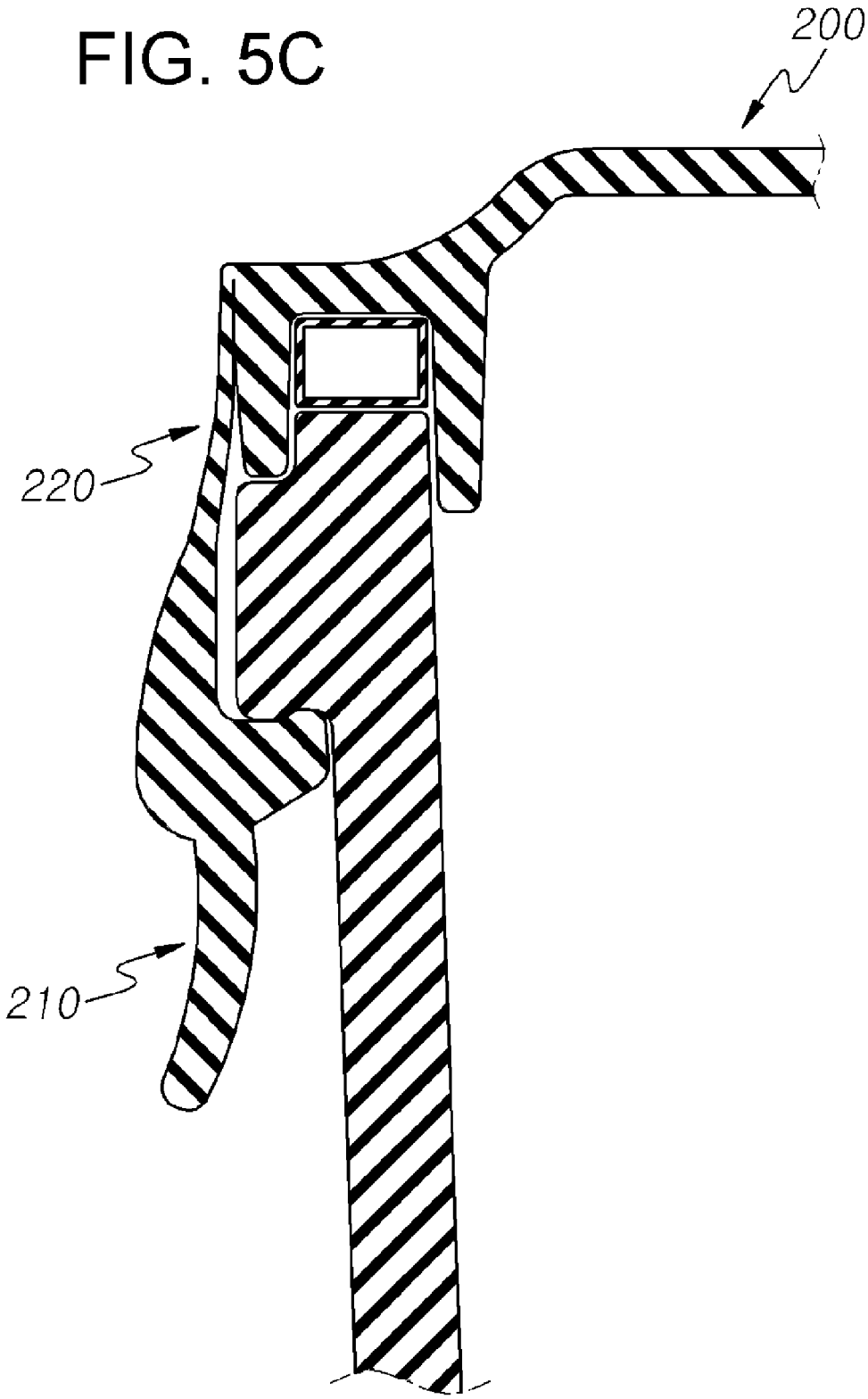

As shown in FIGS. 5A through 5C, each film hinge 220 includes an elastic hinge part 222 and a connection part 224. It is preferable for the film hinge 220 to have a thickness ranging from 0.5 mm to 0.7 mm. Furthermore, preferably, each film hinge 220 is gradually increased in thickness from the outer surface 202 of the rim part of the lid 200 toward the outer edge of the locking flap handle 210.

Referring to FIG. 5A, the film hinge 220 is configured such that, when the locking flap handle 210 is in an outwardly extended state, the elastic hinge part 222 is continuous with the upper surface of the lid 200 and is smoothly curved in the outward direction of the locking flap handle 210, that is, upwards, when seen in FIG. 5A, without having a stepped portion. When the locking protrusion 212 is locked to the locking depression 110, the elastic hinge part 222 is folded onto the outer surface 202 of the rim part of the lid 200 around an inner corner IC, which forms a boundary between the outer surface 202 of the lid 200 and the inner surface of the elastic hinge part 222. In addition, the inner surface of the elastic hinge part 222 is brought into contact with the outer surface 202 of the lid 200, and, simultaneously, the elastic hinge part 222 is elastically bent.

The connection part 224, which connects the elastic hinge part 222 to the locking flap handle 210, has a predetermined length $l_1$ (preferably, ranging from 5 mm to 7 mm) and serves to disperse impact generated when the locking protrusion 212 is coupled to the locking depression 110. That is, the present invention is configured such that a locking section L, which is defined between the inner corner IC of the elastic hinge part 222 and the locking depression 110, is relatively long, so that the impact generated when locking is performed can be effectively absorbed and dispersed.

Figure 1A:
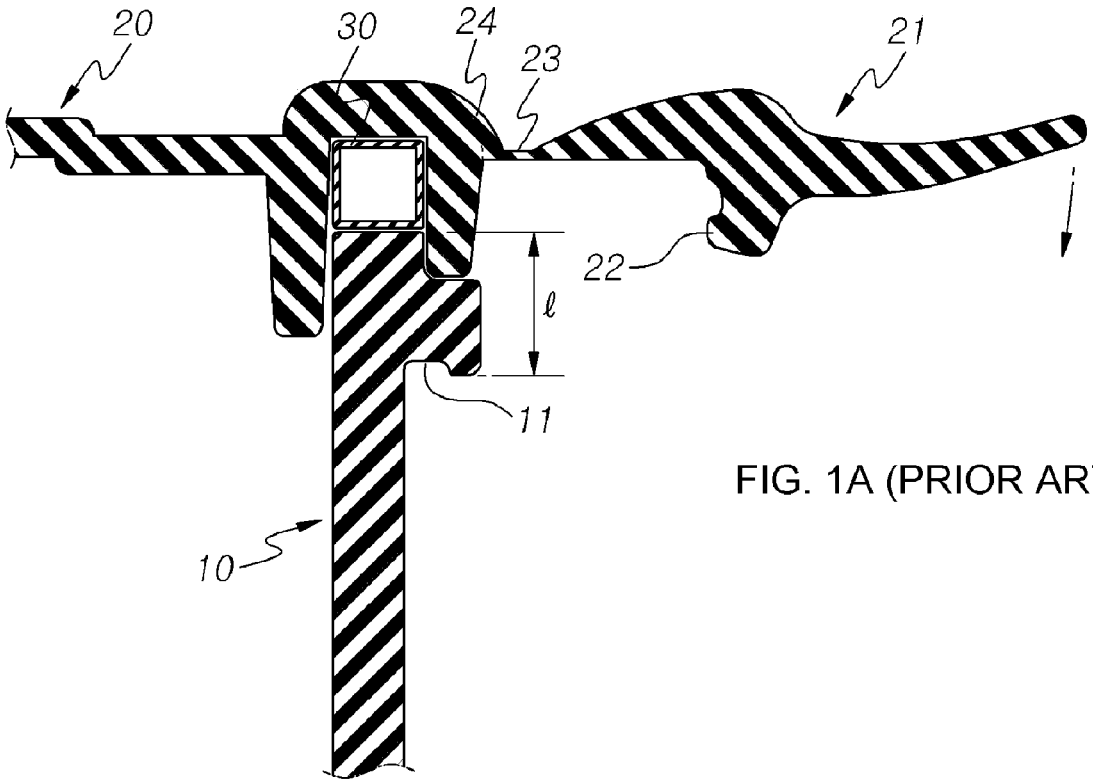
FIG. 1A (PRIOR ART)
FIGS. 1A and 1B are enlarged sectional views showing critical parts of a container body and a lid to illustrate the coupling therebetween, according to a conventional technique.
Figure 1B:
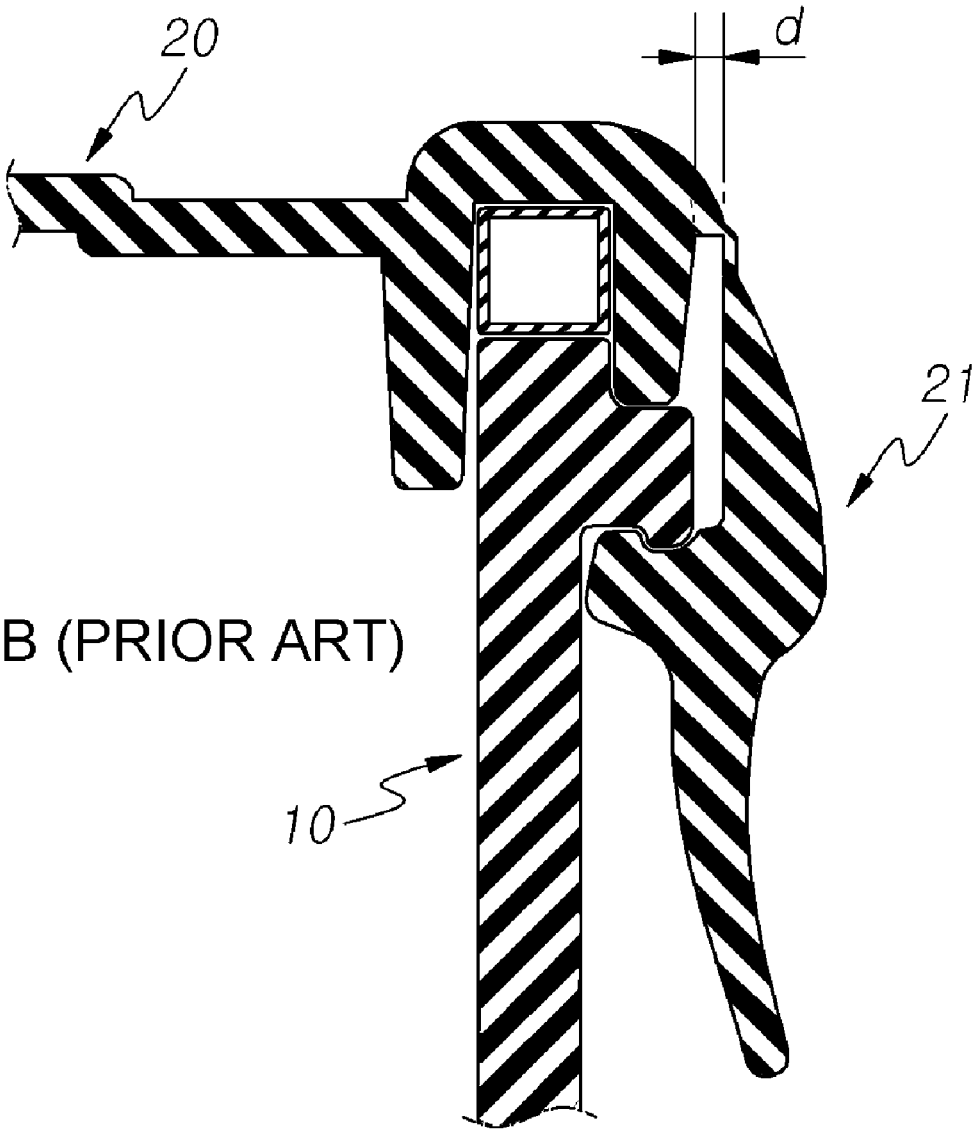
FIG. 1B (PRIOR ART)

In summary, the lid 200 of the invention for the airtight container 100 having an upper open end, comprises a lid body having a rim part defining a sealing depression 230 for receiving and for sealing to the upper open end of the container 100 as shown in FIGS. 5A, 5B and 5C. This rim part has an upper surface and an outer surface 202 connected to the upper surface to define a rim part corner with the upper surface, the lid body including a plurality of locking flap handles 210 each connected to the lid body at the rim part corner for rotation of each locking flap handle 210 between an open position of FIG. 5A and locked positions of FIG. 5C, with respect to the container 100. Each of the locking flap handles 210 has a locking protrusion 212 to be locked to a locking depression 110 formed in an outer surface of the upper open end of the container 100 when the locking flap handles are in their locked positions shown in FIG. 5C. The locking flap handles 210 each include a film hinge 220 having an elastic hinge part 222 for connecting each respective locking flap handle 210 to the rim part corner, and a connection part 224 connecting the elastic hinge part 222 to a remainder of the locking flap handle 210 that carries the locking protrusion 212. As shown in FIG. 5A, the elastic hinge part 222, when the locking flap handle 210 is in the open position, has an outer surface that forms a smooth, continuous, curved, uninterrupted and following surface with the upper surface of the rim part of lid 200, without having a stepped portion as in the prior art of FIG. 1A, the outer surface of the elastic hinge part 222 with the following upper surface of the rim part together being curved outwards at a single predetermined curvature as is clear from FIG. 5A. The elastic hinge part 222 also has a thickness that is at a minimum at the rim part corner that also corresponds to the inside corner IC of the elastic hinge part 222, with the thickness of the film hinge 220 smoothly increasing in the connection part 224 in a direction toward the locking protrusion 212. The connection part 224 for connecting the elastic hinge part 222 to the remainder of the locking flap handle 210 extends a predetermined length L to disperse an impact generated when the locking flap handle is locked to the container. When the locking flap handle 210 is in the locked position to the container 100 as shown in FIG. 5C, the elastic hinge part 222 is folded around the inner corner IC of the elastic hinge part 222 that is at the rim part corner, thus forming a boundary between the elastic hinge part 222 and the lid body, and the elastic hinge part 222 is elastically in contact with the outer surface 202 of the rim part of the lid body.

Preferably, the film hinge 220, which includes the elastic hinge part 222 and the connection part 224, has a length ranging from 8 mm to 12 mm.

The operation of coupling the lid 200 of the present invention having the above-mentioned construction to the container body will be explained in detail herein below with reference to FIGS. 5A through 5C.

First, as shown in FIG. 5A, in the state in which the sealing member 300 of the lid 200 is brought into contact with the edge of the open upper end of the container body 100, a user pushes the lid 200 using his/her one hand and holds and rotates the locking flap handle 210 in the direction of the arrow using the other hand. Then, the film hinge 220 is folded around the inner corner IC.

Then, when the locking flap handle 210 is rotated until the locking protrusion 212 approaches the locking depression 110, as shown in FIG. 5B, the inner surface of the elastic hinge part 222 is brought into contact with the outer surface 202 of the rim part of the lid 200. When the locking flap handle 210 is further rotated, the elastic hinge part 222 is elastically bent and is completely brought into contact with the outer surface 202 of the lid 200.

Subsequently, when the locking flap handle 210 is pushed with still more force, as shown in FIG. 5*c*, the locking protrusion 212 is locked to the locking depression 110. At this time, although an impact is generated and is transmitted to the relatively thin film hinge 220 of the locking flap handle 210, because the impact is evenly dispersed and absorbed by the connection part 224 and the elastic hinge part 222, the problem of cracking occurring due to repetition of the opening and closing of the locking flap handle 210 is markedly mitigated. Furthermore, in the present invention, thanks to the structure of the film hinge 220 including the elastic hinge part 222 and the connection part 224, because the locking section L is relatively long, the distance to which impact generated by the locking operation is transmitted is also increased. Hence, the intensity of impact applied to the inner corner IC is markedly reduced.

In addition, when the container body 100 is formed, if the locking section L becomes relatively long due to a relatively low contraction rate, because the impact of locking can be dispersed by the film hinge 220, the durability of the lid 200 can be increased.

As well, because the film hinge 220 is formed such that it is continuous with the upper surface of the lid 200 rather than having a stepped portion, the smooth flow of raw material when forming the lid 200 is ensured, so that a defective forming phenomenon, such as an unforming or albinic phenomenon, can be prevented.

Particularly, in the present invention, because the elastic hinge part 222 is brought into contact with the outer surface 202 of the rim part of the lid 200, a creep phenomenon, occurring when the locking operation is conducted, can be effectively prevented.

As described above, the present invention provides a lid for airtight containers in which each of film hinges includes an elastic hinge part and a connection part, so that the impact generated when locking the lid to a container body is absorbed and dispersed by the film hinges, thus improving the durability of the lid.

Furthermore, even if the container body is formed such that the locking section of the container body is relatively long, the impact of locking can be dispersed by the film hinge. In addition, because each film hinge is continuous with the upper surface of the lid, rather than having a stepped portion, the smooth flow of raw material when forming the lid is ensured, so that a defective forming phenomenon can be prevented.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A lid (200) for an airtight container (100) having an upper open end, the lid comprising:

a lid body having a rim part defining a sealing depression (230) for receiving and for sealing to the upper open end of the container, the rim part having an upper surface and an outer surface (202) connected to the upper surface to define a rim part corner with the upper surface, the lid body including a plurality of locking flap handles (210) each connected to the lid body at the rim part corner for rotation of each locking flap handle (210) between an open position and locked positions with respect to the container (100), each of the locking flap handles (210) having a locking protrusion (212) to be locked to a locking depression (110) formed in an outer surface of the upper open end of the container (100) when the locking flap handles are in the locked positions;

the locking flap handles each including a film hinge (220) having an elastic hinge part (222) connecting each respective locking flap handle (210) to the rim part corner, and a connection part (224) connecting the elastic hinge part (222) to a remainder of the locking flap handle (210) that has the locking protrusion (212);

the elastic hinge part (222), when the locking flap handle (210) is in the open position, having an outer surface that forms a smooth, continuous, curved, uninterrupted and following surface with the upper surface of the rim part without having a stepped portion, the outer surface of the elastic hinge part (222) with the following upper surface of the rim part together being curved outwards at a single predetermined curvature, the elastic hinge part (222) having thickness that is at a minimum at the rim part corner, with the thickness of the film hinge (220) smoothly increasing in the connection part (224) in a direction toward the locking protrusion (212);

the connection part (224) for connecting the elastic hinge part (222) to the remainder of the locking flap handle (210), extending a predetermined length (L) to disperse an impact generated when the locking flap handle is locked to the container; and wherein, when the locking flap handle (210) is in the locked position to the container, the elastic hinge part (222) is folded around an inner corner (IC) of the elastic hinge part that is at the rim part corner, forming a boundary between the elastic hinge part and the lid body, and the elastic hinge part is elastically in contact with the outer surface (202) of the rim part of the lid body.

2. The lid as set forth in claim 1, wherein the connection part of the film hinge has a length ranging from 8 mm to 12 mm.

3. The lid as set forth in claim 1, wherein the connection part of the film hinge has a thickness ranging from 0.5 mm to 0.7 mm.

* * * * *